US010818236B2

(12) United States Patent
Gai et al.

(10) Patent No.: US 10,818,236 B2
(45) Date of Patent: Oct. 27, 2020

(54) DISPLAY DEVICE, DISPLAY SUBSTRATE, METHOD AND DEVICE FOR DISPLAY COMPENSATION

(71) Applicant: BOE TECHNOLOGY GROUP CO., LTD., Beijing (CN)

(72) Inventors: Cuili Gai, Beijing (CN); Baoxia Zhang, Beijing (CN); Ling Wang, Beijing (CN); Pan Xu, Beijing (CN); Yicheng Lin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 43 days.

(21) Appl. No.: 16/118,192

(22) Filed: Aug. 30, 2018

(65) Prior Publication Data

US 2019/0189056 A1 Jun. 20, 2019

(30) Foreign Application Priority Data

Dec. 15, 2017 (CN) ..... 2017 1 1352588

(51) Int. Cl.
*G09G 3/3258* (2016.01)
*G09G 3/3233* (2016.01)

(52) U.S. Cl.
CPC ... *G09G 3/3258* (2013.01); *G09G 2300/0819* (2013.01); *G09G 2320/0233* (2013.01); *G09G 2320/045* (2013.01)

(58) Field of Classification Search
CPC ..... G09G 3/3258; G09G 2300/0819; G09G 2320/0233; G09G 2320/045
See application file for complete search history.

(56) References Cited

U.S. PATENT DOCUMENTS

| | | | | |
|---|---|---|---|---|
| 2014/0313111 | A1* | 10/2014 | Chaji | G09G 3/3291 345/82 |
| 2015/0123953 | A1* | 5/2015 | Shim et al. | G09G 3/3258 |
| 2015/0179107 | A1* | 6/2015 | Kim | G09G 3/3291 |
| 2015/0379939 | A1* | 12/2015 | Takasugi et al. | G09G 3/3291 |
| 2019/0172394 | A1* | 6/2019 | Wang et al. | G09G 3/3258 |
| 2020/0118489 | A1* | 4/2020 | Lin | G09G 3/3233 |

* cited by examiner

*Primary Examiner* — Temesghen Ghebretinsae
*Assistant Examiner* — Ivelisse Martinez Quiles
(74) *Attorney, Agent, or Firm* — Foley & Lardner LLP

(57) ABSTRACT

The present disclosure relates to a display device, a display substrate, a method and a device for display compensation. The method includes: before displaying an image, performing initial compensation on each of the pixel circuits to obtain an average reference voltage of the plurality of pixel circuits; controlling the display substrate to display an image and performing external compensation on each of the pixel circuits during a display duration of one frame of the image, obtaining a charging voltage on the sensing line of each of the pixel circuits during the external compensation, obtaining a first reference voltage of each of the pixel circuits according to the charging voltage on the sensing line and the average reference voltage, and performing internal compensation on each of the pixel circuits according to the first reference voltage.

18 Claims, 5 Drawing Sheets

DISPLAY DEVICE, DISPLAY SUBSTRATE, METHOD AND DEVICE FOR DISPLAY COMPENSATION

CROSS REFERENCE

The present application is based upon and claims priority to Chinese Patent Application No. 201711352588.7, filed on Dec. 15, 2017, and the entire contents thereof are incorporated herein by reference.

TECHNICAL FIELD

The present disclosure relates to the field of display technology, in particular, to a method for display compensation, a device for display compensation, a display substrate and a display device.

BACKGROUND

With the advancement of time, AMOLED (Active Matrix Organic Light Emitting Diode) products are used more and more widely. The AMOLED has become more and more popular for its advantages such as high contrast, high color gamut, slimness, and flexible.

It should be noted that, information disclosed in the above background portion is provided only for better understanding of the background of the present disclosure, and thus it may contain information that does not form the prior art known by those ordinary skilled in the art.

SUMMARY

The present disclosure provides a method for display compensation, which is applicable to compensate a display substrate including a plurality of pixel circuits each including a driving transistor, a data line, a sensing line and a first power line, the method including: before displaying an image, performing initial compensation on each of the pixel circuits to obtain an average reference voltage of the plurality of pixel circuits; controlling the display substrate to display an image and performing external compensation on each of the pixel circuits during a display duration of one frame of the image, obtaining a charging voltage on the sensing line of each of the pixel circuits during the external compensation, obtaining a first reference voltage of each of the pixel circuits according to the charging voltage on the sensing line and the average reference voltage, and performing internal compensation on each of the pixel circuits according to the first reference voltage.

In addition, the method for display compensation according to the arrangement of the present disclosure may further includes the following additional technical features.

According to an arrangement of the present disclosure, the performing initial compensation on each of the pixel circuits to obtain an average reference voltage of the plurality of pixel circuits includes: providing a detection voltage to the data line of each of the pixel circuits and maintaining the detection voltage for a first time to turn on the driving transistor of each of the pixel circuits. The performing initial compensation on each of the pixel circuits to obtain an average reference voltage of the plurality of pixel circuits includes providing a second reference voltage to the sensing line of each of the pixel circuits and then floating the sensing line of each of the pixel circuits during the first time, to charge a corresponding sensing line with a voltage of the first power line of each of the pixel circuits.

The performing initial compensation on each of the pixel circuits to obtain an average reference voltage of the plurality of pixel circuits includes obtaining the charging voltage on the sensing line of each of the pixel circuits, and obtaining the average reference voltage by averaging the charging voltage on the sensing line of each of the pixel circuits.

According to an arrangement of the present disclosure, during the display duration of one frame of the image, the internal compensation and then the external compensation are performed on each of the pixel circuits.

According to an arrangement of the present disclosure, performing external compensation on any one of the pixel circuits during a display duration of one frame of the image, and obtaining a charging voltage on the sensing line of the pixel circuit during the external compensation includes providing a detection voltage to the data line of the pixel circuit and maintaining the detection voltage for a first time to turn on the driving transistor of the pixel circuit, and applying a first reference voltage in a duration of current frame to the sensing line of the pixel circuit and then floating the sensing line during the first time, to charge the sensing line with a voltage of the first power line of the pixel circuit. The performing external compensation on any one of the pixel circuits during a display duration of one frame of the image, and obtaining a charging voltage on the sensing line of the pixel circuit during the external compensation includes obtaining the charging voltage on the sensing line of the pixel circuit during the external compensation by obtaining a charging voltage on the sensing line during the first time.

According to another arrangement of the present disclosure, performing external compensation on any one of the pixel circuits during a display duration of one frame of the image, and obtaining a charging voltage on the sensing line of the pixel circuit during the external compensation includes providing a detection voltage to the data line of the pixel circuit to turn on the driving transistor of the pixel circuit, and applying a first reference voltage in a duration of current frame to the sensing line of the pixel circuit and then floating the sensing line, to charge the sensing line with a voltage of the first power line of the pixel circuit. The performing external compensation on any one of the pixel circuits during a display duration of one frame of the image, and obtaining a charging voltage on the sensing line of the pixel circuit during the external compensation includes obtaining charging voltages on the sensing line corresponding to any two moments in the charging process, and respectively identifying the charging voltages as a first voltage and a second voltage. The performing external compensation on any one of the pixel circuits during a display duration of one frame of the image, and obtaining a charging voltage on the sensing line of the pixel circuit during the external compensation includes obtaining a charging voltage on the sensing line at the time when a charging time reaches the first time according to the any two moments, the first voltage and the second voltage, to obtain the charging voltage on the sensing line of the pixel circuit during the external compensation.

According to an arrangement of the present disclosure, the obtaining a first reference voltage of any one of the pixel circuits according to the charging voltage on the sensing line and the average reference voltage includes: increasing the first reference voltage of the pixel circuit by a first value in a case where the charging voltage on the sensing line of the pixel circuit is greater than the average reference voltage, to obtain a first reference voltage of the pixel circuit during a next frame; and decreasing the first reference voltage of the pixel circuit by a first value in a case where the charging voltage on the sensing line of the pixel circuit is lower than the average reference voltage, to obtain the first reference voltage of the pixel circuit during the next frame.

According to an arrangement of the present disclosure, the performing internal compensation on any one of the pixel circuits according to the first reference voltage includes: dividing the display duration of one frame of the image into a plurality of stages. The plurality of stages includes a reset stage and an internal compensation stage. In the reset stage, providing the first reference voltage to the data line of the pixel circuit to reset a gate electrode of the driving transistor of the pixel circuit; and in the internal compensation stage, supplying the first reference voltage to the data line of the pixel circuit, and turning on the driving transistor of the pixel circuit, to charge a source electrode of the driving transistor with a voltage of the first power line of the pixel circuit, to perform internal compensation on the driving transistor.

The present disclosure provides a device for display compensation, which is applicable to compensate a display substrate including a plurality of pixel circuits each including a driving transistor, a data line, a sensing line and a first power line, the device including: a full screen compensation circuit configured to, before displaying an image, perform initial compensation on each of the pixel circuits to obtain an average reference voltage of the plurality of pixel circuits; a control circuit configured to control the display substrate to display an image and perform external compensation on each of the pixel circuits during a display duration of one frame of the image, obtain a charging voltage on the sensing line of each of the pixel circuits during the external compensation, obtain a first reference voltage of each of the pixel circuits according to the charging voltage on the sensing line and the average reference voltage, and perform internal compensation on each of the pixel circuits according to the first reference voltage.

In addition, the device for display compensation according to the arrangement of the present disclosure may further includes the following additional technical features.

According to an arrangement of the present disclosure, when the full screen compensation circuit performs initial compensation on each of the pixel circuits to obtain an average reference voltage of the plurality of pixel circuits, the full screen compensation circuit provides a detection voltage to the data line of each of the pixel circuits and maintains the detection voltage for a first time to turn on the driving transistor of each of the pixel circuits, and provides a second reference voltage to the sensing line of each of the pixel circuits during the first time and then floats the sensing line of each of the pixel circuits, to charge a corresponding sensing line with a voltage of the first power line of each of the pixel circuits; and the full screen compensation circuit obtains the charging voltage on the sensing line of each of the pixel circuits, and obtains the average reference voltage by averaging the charging voltage on the sensing line of each of the pixel circuits.

According to an arrangement of the present disclosure, during the display duration of one frame of the image, the control circuit performs the internal compensation and then the external compensation on each of the pixel circuits.

According to an arrangement of the present disclosure, when the control circuit performs external compensation on any one of the pixel circuits and obtains a charging voltage on the sensing line of the pixel circuit during the external compensation, the control circuit provides a detection voltage to the data line of the pixel circuit and maintains the detection voltage for a first time to turn on the driving transistor of the pixel circuit, and applies a first reference voltage in a duration of current frame to the sensing line of the pixel circuit and then floats the sensing line during the first time, to charge the sensing line with a voltage of the first power line of the pixel circuit; and the control circuit obtains the charging voltage on the sensing line of the pixel circuit during the external compensation by obtaining a charging voltage on the sensing line during the first time.

According to another arrangement of the present disclosure, when the control circuit performs external compensation any one of the pixel circuits and obtains a charging voltage on the sensing line of the pixel circuit during the external compensation, the control circuit provides a detection voltage to the data line of the pixel circuit to turn on the driving transistor of the pixel circuit, and applies a first reference voltage in a duration of current frame to the sensing line of the pixel circuit and then floats the sensing line, to charge the sensing line with a voltage of the first power line of the pixel circuit; the control circuit obtains charging voltages on the sensing line corresponding to any two moments in the charging process, and respectively identifying the charging voltages as a first voltage and a second voltage; and the control circuit obtains a charging voltage on the sensing line at the time when a charging time reaches the first time according to the any two moments, the first voltage and the second voltage, to obtain the charging voltage on the sensing line of the pixel circuit during the external compensation.

According to an arrangement of the present disclosure, when the control circuit obtains a first reference voltage of any one of the pixel circuits according to the charging voltage on the sensing line and the average reference voltage, the control circuit increases the first reference voltage of the pixel circuit by a first value in a case where the charging voltage on the sensing line of the pixel circuit is greater than the average reference voltage, to obtain a first reference voltage of the pixel circuit during a next frame; and decreases the first reference voltage of the pixel circuit by a first value in a case where the charging voltage on the sensing line of the pixel circuit is lower than the average reference voltage, to obtain the first reference voltage of the pixel circuit during the next frame.

According to an arrangement of the present disclosure, when the control circuit performs internal compensation on any one of the pixel circuits according to the first reference voltage, the control circuit divides the display duration of one frame of the image into a plurality of stages. The plurality of stages includes a reset stage and an internal compensation stage. In the reset stage, the control circuit provides the first reference voltage to the data line of the pixel circuit to reset a gate electrode of the driving transistor of the pixel circuit; and in the internal compensation stage, the control circuit supplies the first reference voltage to the data line of the pixel circuit, and turns on the driving transistor of the pixel circuit, to charge a source electrode of the driving transistor with a voltage of the first power line of the pixel circuit, to perform internal compensation on the driving transistor.

The present disclosure provides a display substrate including the above device for display compensation.

The present disclosure provides a display device including the above display substrate.

It is to be understood that both the foregoing general description and the following detailed description are exemplary and explanatory only and are not restrictive of the disclosure.

This section provides a summary of various implementations or examples of the technology described in the disclosure, and is not a comprehensive disclosure of the full scope or all features of the disclosed technology.

DETAILED DESCRIPTION

Figure 1:
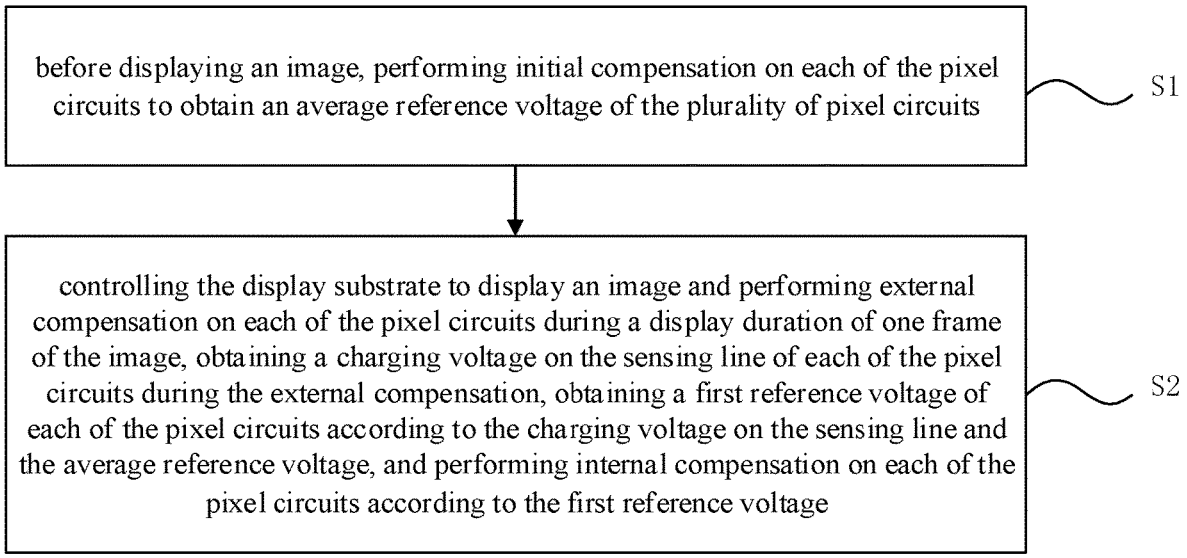
FIG. 1 illustrates a flowchart of the method for display compensation according to arrangements of the present disclosure.

Hereinafter, the arrangements of the present disclosure are described in detail, and the examples of the arrangements are illustrated in the drawings. The same or similar reference numerals are used to refer to the same or similar elements or elements having the same or similar functions. The arrangements described below with reference to the accompanying drawings are intended to be illustrative for explaining the present disclosure, and are not to be construed as limiting.

A method for display compensation, a device for display compensation, a display substrate, and a display device according to arrangements of the present disclosure will be described below with reference to the accompanying drawings.

Generally, when a display product (such as an AMOLED product) is manufactured, the threshold voltage of the driving transistor in the display product drifts due to process, material, and design reasons, which may cause uneven display of the product and poor display effect.

In view of the above problems, it is generally solved by compensating the threshold voltage of the driving transistor, and the compensation for the threshold voltage mainly includes two categories, namely internal compensation and external compensation. However, at present, the compensation capability of internal compensation is limited. For example, the characteristic change of the driving transistor cannot be completely covered, and the external compensation may tend to generate the compensation trace, that is, the compensation mura. That is, after external compensation, the brightness of the display product is uneven, resulting in various traces and resulting in poor final display. Also, the external compensation has a limited real-time compensation capability. Therefore, whether it is internal compensation or external compensation, it will not be able to meet various requirements.

However, according to careful analysis and research on internal compensation and external compensation, it is found that internal compensation has limitation to compensate and cannot completely cover the variation of the characteristics of the driving transistor. The internal compensation does not produce compensation traces, and at the same time, the internal compensation is able to compensate for the variation of the characteristics of the driving transistor in real time. In addition, for external compensation, although the compensation trace is easy to occur and the compensation time efficiency is poor, the compensation range of the external compensation is wide, and may cover a wide range of the variation of the characteristics of the drive transistor The present disclosure fully utilizes the advantages of internal compensation and external compensation to compensate the pixel circuit, which not only can realize the threshold voltage compensation of the driving transistor, but also solve the problem of display unevenness caused by the threshold voltage drift, and can cover a wide range of the variation of the characteristics of the drive transistor, and can perform real-time compensation of the characteristic variation of the driving transistor, and can eliminate traces generated by external compensation, so that the display effect is better.

FIG. 1 is a flow chart of the method for display compensation according to arrangements of the present disclosure.

The method for display compensation according to arrangements of the present disclosure is applicable to compensate a display substrate including a plurality of pixel circuits each including a driving transistor, a data line, a sensing line and a first power line.

As illustrated in FIG. 1, the method for display compensation according to arrangements of the present disclosure includes at least S1 and S2.

In S1, the method includes before displaying an image, performing initial compensation on each of the pixel circuits to obtain an average reference voltage of the plurality of pixel circuits.

According to an arrangement of the present disclosure, a method to perform initial compensation on each of the pixel circuits to obtain an average reference voltage of the plurality of pixel circuits includes providing a detection voltage to the data line of each of the pixel circuits and maintaining the detection voltage for a first time to turn on the driving transistor of each of the pixel circuits. The method includes providing a second reference voltage to the sensing line of each of the pixel circuits and then floating the sensing line of each of the pixel circuits during the first time, to charge a corresponding sensing line with a voltage of the first power line of each of the pixel circuits. The method includes obtaining the charging voltage on the sensing line of each of the pixel circuits, and obtaining the average reference voltage by averaging the charging voltage on the sensing line of each of the pixel circuits.

That is to say, before displaying an image, the full screen is sensed firstly, and the sensing method is implemented according to the external compensation waveform. That is, each pixel circuit in the display substrate is compensated by an external compensation method, so that a voltage is obtained on the sensing line of each pixel circuit, and then the average reference voltage of all pixel circuits is calculated based on these voltages.

In order to enable those skilled in the art to more clearly understand the present disclosure, a specific pixel circuit shown in FIG. 2 will be described in detail below as an example.

Figure 2:
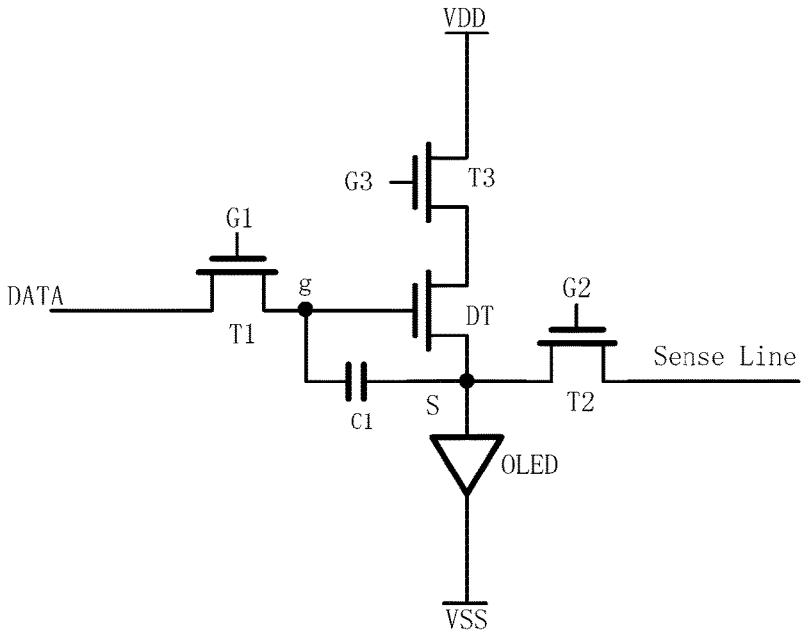
FIG. 2 is a schematic structural diagram of the pixel circuit according to an arrangement of the present disclosure.

As shown in FIG. 2, the pixel circuit includes a driving transistor DT, a first transistor T1, a second transistor T2, a third transistor T3, a storage capacitor C1, a light emitting device OLED, a data line DATA, a sensing line Sense Line, a first power line VDD, a second power line VSS, a first control line G1, a second control line G2, and a third control line G3.

In the present arrangement, the first transistor T1 is a switching transistor, and the control electrode of the first transistor T1 is connected to the first control line G1. The first electrode of the first transistor T1 is connected to the data line DATA, and the second electrode of the first transistor T1 is coupled to the driving transistor DT and one end of the gate and the storage capacitor C1, respectively. The control electrode of the second transistor T2 is connected to the second control line G2, the first electrode of the second transistor T2 is connected to the sensing line Sense Line, and the second electrode of the second transistor T2 is connected to the source electrode of the driving transistor DT, the other end of the storage capacitor C1, and one end of the light emitting device OLED, respectively. The second transistor T2 is used to reset the source electrode of the driving transistor DT. The control electrode of the third transistor T3 is connected to the third The control line G3, the first electrode of the third transistor T3 is connected to the first power line VDD, the second electrode of the third transistor T3 is connected to the drain of the driving transistor DT. The third transistor T3 is used for controlling the first power line VDD. The other end of the light emitting device OLED is connected to the second power line VSS. In this example, the first to third transistors T1 to T3 and the driving transistor DT are all N-type transistors.

As shown in FIG. 2, when initial compensation is performed, high level may be output to the first control line G1 to the third control line G3 of each pixel circuit respectively through an external control unit (e.g., an IC chip of the GOA area). At this time, the first transistor T1 to the third transistor T3 of each pixel circuit are turned on, and the external control unit outputs the detection voltage V1 (such as 3V) to the data line DATA of each pixel circuit, and outputs the second reference voltage Vref2 to the sensing line Sense Line and then floats the sensing line Sense Line. At this time, the driving transistor DT in the pixel circuit is turned on, and the voltage of the first power supply line VDD of the pixel circuit charges the sensing line Sense Line through the third transistor T3 and the driving transistor DT. When the charging time reaches the first time Ta (Ta needs to ensure that the sensing line Sense Line is not charged to saturation), the charging voltage on the sensing line Sense Line of each pixel circuit is obtained, and then the obtained charging voltage on the sensing line Sense Line of each pixel circuit may be summed up and then divided by the total number of the pixel circuits, to obtain the average reference voltage Vtarget.

It should be noted that, in the arrangement of the present disclosure, other methods may be used to externally compensate the pixel circuit to obtain the average reference voltage Vtarget. However, the above manner is relatively simple and easy to implement, so it is optional to adopt the above external compensation method to obtain the average reference voltage Vtarget.

It should also be noted that in the present disclosure, the term "unit" may represent a circuit structure that is configured accordingly, or may also represent other software or hardware modules or a combination thereof that are configured accordingly.

In S2, the method includes controlling the display substrate to display an image and performing external compensation on each of the pixel circuits during a display duration of one frame of the image, obtaining a charging voltage on the sensing line of each of the pixel circuits during the external compensation, obtaining a first reference voltage of each of the pixel circuits according to the charging voltage on the sensing line and the average reference voltage, and performing internal compensation on each of the pixel circuits according to the first reference voltage.

According to an arrangement of the present disclosure, during the display duration of one frame of the image, the internal compensation and then the external compensation are performed on each of the pixel circuits.

In particular, one frame time of the image display may be divided into a display time and a black insertion time (blank area). In the present arrangement, in the display time, internal compensation is performed on corresponding pixel circuit according to the first reference voltage of the pixel circuit obtained by external compensation according to the previous frame time, and then in the black insertion time, externally compensation is performed on the corresponding pixel circuit according to the first reference voltage used for internal compensation, and the reference voltage obtained by external compensation is used as the first reference voltage when performing internal compensation on the pixel circuit during the next frame. That is, the present disclosure adjusts the reference voltage of the corresponding pixel circuit during internal compensation by external compensation, thus achieving the purpose of improving the display effect.

It should be noted that, while displaying image, since the internal compensation is performed and then the external compensation is performed during every frame, when the internal compensation is performed in the first frame time, the second reference voltage Vref2 used in the full screen external compensation is directly used. That is, in the first frame time, both the internal compensation and external compensation are performed using the second reference voltage Vref2, and then the reference voltage obtained by external compensation in the first frame time is taken as the first reference voltage of the corresponding pixel circuit in the next frame time.

According to an arrangement of the present disclosure, the performing internal compensation on any one of the pixel circuits according to the first reference voltage includes: dividing the display duration of one frame of the image into a plurality of stages. The plurality of stages includes a reset stage and an internal compensation stage. The performing internal compensation on any one of the pixel circuits according to the first reference voltage includes: in the reset stage, providing the first reference voltage to the data line of the pixel circuit to reset a gate electrode of the driving transistor of the pixel circuit; and in the internal compensation stage, supplying the first reference voltage to the data line of the pixel circuit, and turning on the driving transistor of the pixel circuit, to charge a source electrode of the driving transistor with a voltage of the first power line of the pixel circuit, to perform internal compensation on the driving transistor.

Figure 3:
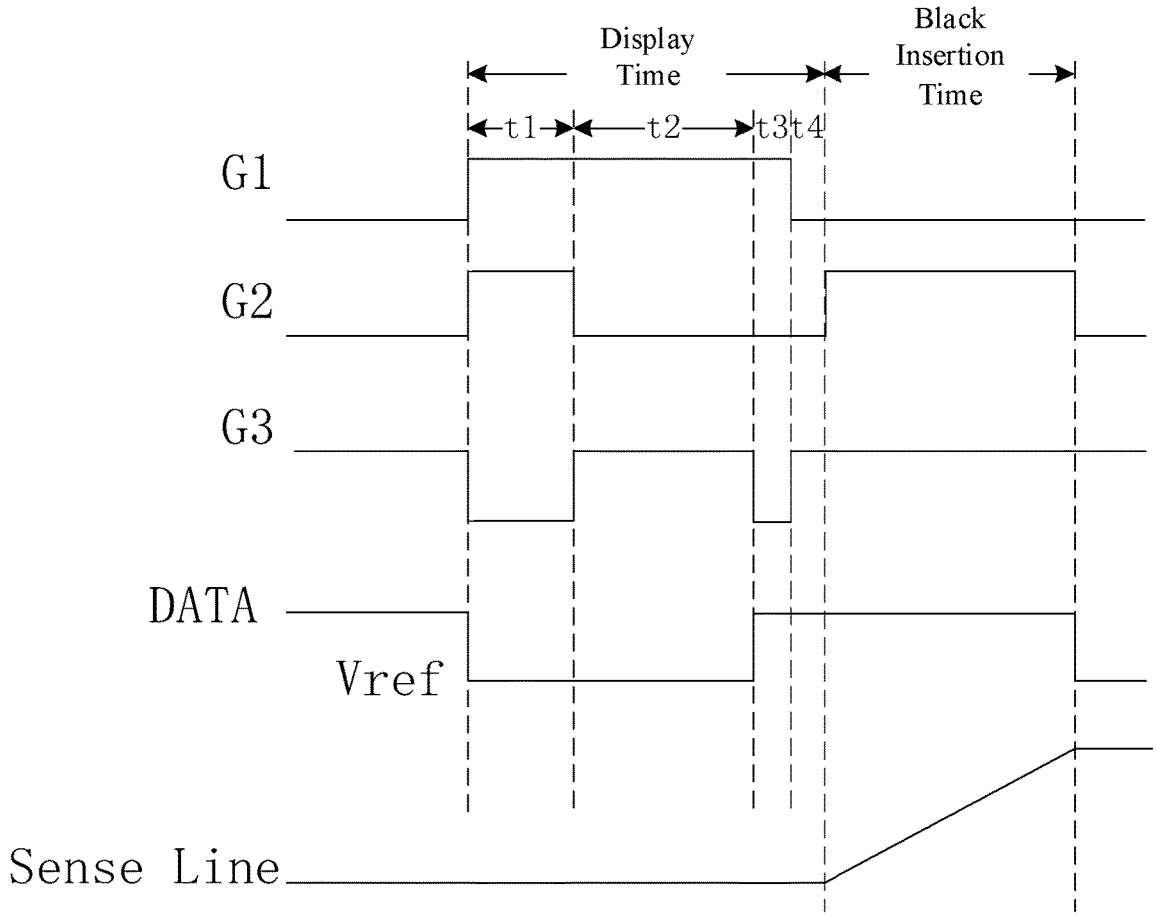
FIG. 3 is a timing diagram of the pixel circuit illustrated in FIG. 2.

In particular, the pixel circuit shown in FIG. 2 is still taken as an example. As shown in FIG. 2 and FIG. 3, one frame time of the image display may include a display time and a black insertion time. The display time may further include multiple stages, which are a reset stage, an internal compensation stage, a data writing phase, and an emission stage.

In the arrangement, in the reset stage t1, the external control unit outputs a high level to the first control line G1 and the second control line G2, respectively, and the first transistor T1 and the second transistor T2 are both turned on, and at the same time, the external control unit outputs the first reference voltage Vref1 of the pixel circuit (if it is the first frame time, the reference voltage is the reference voltage Vref2) obtained by the external compensation in the previous frame time to the data line DATA, and input a reset voltage (such as 0V) to the sensing line Sense Line, to reset the voltage across the storage capacitor C1.

In the internal compensation stage t2: the external control unit outputs a high level to the first control line G1 and the third control line G3, respectively, the first transistor T1 and the third transistor T3 are both turned on, and the external control unit outputs the first reference voltage Vref1 of the pixel circuit obtained by external compensation of the previous frame (if it is the first frame time, the reference voltage is the reference voltage Vref2) to the data line DATA, the driving transistor DT is turned on, the source electrode of the drive transistor DT (i.e., point S) is charged by the voltage of the first power line VDD, to perform threshold voltage compensation.

In the data writing stage t3: the external control unit outputs a high level to the first control line G1, and the first transistor T1 is turned on. At the same time, the external control unit outputs the display data voltage Vdata to the data line DATA to write the display data voltage Vdata to the gate of the driving transistor DT. At this time, the voltage of the gate (i.e., point g) of the driving transistor DT is Vdata, and the source of the driving transistor DT (i.e., point S) is pulled up due to the capacitive coupling principle of the storage capacitor C1.

In the emission stage t4: the external control unit outputs a high level to the third control line G3, and the third transistor T3 is turned on, and under the action of the storage capacitor C1, the driving transistor DT is turned on, and the anode voltage of the light emitting device OLED (i.e., the voltage at the point S) is gradually increased to the light-emitting voltage of the light-emitting device OLED, and the light-emitting device OLED emits light.

Thus, by internally compensating the pixel circuit with the reference voltage obtained by external compensation, the display effect of the entire display substrate can be effectively improved.

After the internal compensation of the pixel circuit is completed, the pixel circuit is externally compensated during the black insertion time of the current frame, and the charging voltage on the sensing line during external compensation is obtained to further obtain the first reference voltage of the pixel circuit while performing internal compensation in the next frame time according to the charging voltage of the sensing line and the average reference voltage.

According to an arrangement of the present disclosure, performing external compensation on any one of the pixel circuits during a display duration of one frame of the image, and obtaining a charging voltage on the sensing line of the pixel circuit during the external compensation includes: providing a detection voltage to the data line of the pixel circuit and maintaining the detection voltage for a first time to turn on the driving transistor of the pixel circuit, and applying a first reference voltage in a duration of current frame to the sensing line of the pixel circuit and then floating the sensing line during the first time, to charge the sensing line with a voltage of the first power line of the pixel circuit; and obtaining the charging voltage on the sensing line of the pixel circuit during the external compensation by obtaining a charging voltage on the sensing line during the first time.

In particular, as shown in FIG. 2, in the external compensation, the high level may be respectively output to the first control line G1 to the third control line G3 through the external control unit, and the first transistor T1 to the third transistor T3 are all turned on. At the same time, the external control unit outputs the detection voltage V1 (for example, 3V) to the data line DATA of the pixel circuit, and outputs the first reference voltage Vref1 when the pixel circuit performs internal compensation in the current frame time to the sensing line Sense Line and then floats the sensing line Sense Line. At this time, the driving transistor DT is turned on, and the voltage of the first power line VDD charges the sensing line Sense Line through the third transistor T3 and the driving transistor DT. When the charging time reaches the first time Ta, the charging voltage on the sensing line Sense Line is obtained, that is, the charging voltage Vsen on the sensing line of the pixel circuit during the external compensation is obtained.

It should be noted that, in this example, by controlling the first transistor T1 to be turned on, and inputting the detection voltage V1 (such as 3V) to the data line DATA to ensure that the detection voltage used during the external compensation for the pixel circuit in each frame time and that used during the external compensation of the full screen are the same. While in other arrangements of the present disclosure, the detection voltage used for external compensation of the full screen may also be set to the display data voltage Vdata, so that during each frame time, when the pixel circuit is externally compensated, the first transistor T1 may be kept off by the energy storage function of the storage capacitor C1, and meanwhile ensure that the detection voltage used during the external compensation for the pixel circuit in each frame time and that used during the external compensation of the full screen are the same.

Specifically, as shown in FIG. 2 and FIG. 3, in the external compensation, the high level is respectively output to the second control line G2 and the third control line G3 through the external control unit, and the second transistor T2 and the third transistors T3 are all turned on. At the same time, the external control unit outputs the first reference voltage Vref1 when the pixel circuit performs internal compensation in the current frame time to the sensing line Sense Line and then causes the sensing line Sense Line to be in a floating state. At this time, under the action of the storage capacitor C1, the driving transistor DT is turned on, and the voltage of the first power source line VDD charges the sensing line Sense Line through the third transistor T3 and the driving transistor DT. When the charging time reaches the first time Ta, the charging voltage on the sensing line Sense Line is obtained, that is, the charging voltage Vsen on the sensing line of the pixel circuit during the external compensation is obtained.

That is, no matter which method is adopted, the method is functional as long as the detection voltage used for external compensation of the pixel circuit in each frame time is the same as the detection voltage used for external compensation of the full screen, that is, as long as the charging voltage Vsen on the sensing line and the average reference voltage Vtarget are obtained under the same condition. Accordingly, the first reference voltage used in the internal compensation of the corresponding pixel circuit obtained according to the charging voltage Vsen on the sensing line and the average reference voltage Vtarget is relatively reliable.

According to another arrangement of the present disclosure, performing external compensation on any one of the pixel circuits during a display duration of one frame of the image, and obtaining a charging voltage on the sensing line of the pixel circuit during the external compensation includes: providing a detection voltage to the data line of the pixel circuit to turn on the driving transistor of the pixel circuit, and applying a first reference voltage in a duration of current frame to the sensing line of the pixel circuit and then floating the sensing line, to charge the sensing line with a voltage of the first power line of the pixel circuit; obtaining charging voltages on the sensing line corresponding to any two moments in the charging process, and respectively identifying the charging voltages as a first voltage and a second voltage; and obtaining a charging voltage on the sensing line at the time when a charging time reaches the first time according to the any two moments, the first voltage and the second voltage, to obtain the charging voltage on the sensing line of the pixel circuit during the external compensation.

Figure 4:
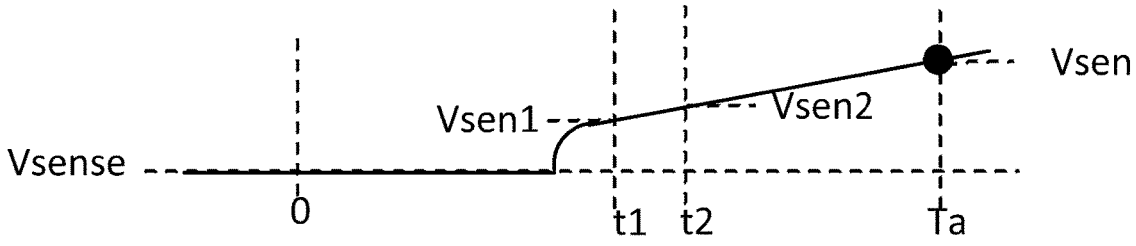
FIG. 4 is a schematic diagram illustrating obtaining the charging voltage on the sensing line.

Specifically, as shown in FIG. 2, in the external compensation, the high level may be respectively output to the first control line G1 to the third control line G3 through the external control unit, and the first transistor T1 to the third transistor T3 are turned on in this case. At the same time, the external control unit outputs the detection voltage V1 (such as 3V) to the data line DATA of the pixel circuit, and outputs the first reference voltage Vref1 when the pixel circuit performs internal compensation in the current frame time to the sensing line Sense Line and then flows the sensing line Sense Line. At this time, the driving transistor DT is turned on, and the voltage of the first power line VDD is charged to the sensing line Sense Line through the third transistor T3 and the driving transistor DT. During the charging process, the charging voltages on the sensing line corresponding to any two moments are obtained. For example, as shown in FIG. 4, the first voltage Vsen1 corresponding to the first time t1 and the second voltage Vsen2 corresponding to the second time t2 are acquired (The first time t1 and the second time t2 are both smaller than the first time Ta), and then according to the voltage difference ΔVsen between the second voltage Vsen2 and the first voltage Vsen1 and the time difference Δt between the second time t2 and the first time t1, the voltage on the sense line Sense Line when the charging time reaches the first time Ta is calculated, to obtain the charging voltage Vsen on the sensing line of the pixel circuit when external compensation is obtained, that is, Vsen=Vsen1+(Vsen2−Vsen1)*[(Ta−t1)/(t2−t1)].

Alternatively, as shown in FIG. 2 and FIG. 3, in external compensation, a high level may be respectively output to the second control line G2 and the third control line G3 through the external control unit, and the second transistor T2 and the third transistor T3 are turned on. Tt this time and, the external control unit outputs the first reference voltage Vref1 when the pixel circuit performs internal compensation in the current frame time to the sensing line Sense Line and then makes the sensing line Sense Line in a floating state. At this time, under the action of the storage capacitor C1, the driving transistor DT is turned on, and the voltage of the first power supply line VDD charges the sensing line Sense Line through the third transistor T3 and the driving transistor DT. During the charging process, the charging voltages on the sensing line corresponding to any two moments are obtained, for example, the first voltage Vsen1 corresponding to the first time t1 and the second voltage Vsen2 corresponding to the second time t2 are obtained, and then according to the voltage difference ΔVsen between the first voltage Vsen1 the second voltage Vsen2 and the time difference Δt between the second time t2 and the first time t1, the voltage on the corresponding sensing line Sense Line when the charging time reaches the first time Ta is calculated, to obtain the charging voltage Vsen on the sensing line of the pixel circuit at the time of external compensation, that is, Vsen=Vsen1+(Vsen2−Vsen1)*[(Ta−t1)/(t2−t1)].

That is, when the charging voltage Vsen on the sensing line of the pixel circuit is obtained, the sensing line Sense Line can be charged to the first time Ta, and then the voltage on the sensing line Sense Line is obtained; or, during charging of the sensing line Sense Line, the charging voltage Vsen on the sensing line Sense Line when the charging time reaches the first time Ta is predicted according to the rate of change of the voltage on the sensing line Sense Line. Among them, for the former, the charging voltage Vsen on the sensing line obtained is more accurate, and for the latter, the detection time is shorter, and the external compensation time is effectively shortened.

Further, after obtaining the charging voltage Vsen and the average reference voltage Vtarget on the sensing line, it may start to obtain the first reference voltage Vref1 used in the internal compensation of the corresponding pixel circuit in the next frame time according to the charging voltage Vsen on the sensing line and the average reference voltage Vtarget.

According to an arrangement of the present disclosure, the obtaining a first reference voltage of any one of the pixel circuits according to the charging voltage on the sensing line and the average reference voltage includes: increasing the first reference voltage of the pixel circuit by a first value in a case where the charging voltage on the sensing line of the pixel circuit is greater than the average reference voltage, to obtain a first reference voltage of the pixel circuit during a next frame; and decreasing the first reference voltage of the pixel circuit by a first value in a case where the charging voltage on the sensing line of the pixel circuit is lower than the average reference voltage, to obtain the first reference voltage of the pixel circuit during the next frame.

Specifically, after the charging voltage Vsen on the sensing line is obtained in the above manner, the charging voltage Vsen on the sensing line and the average reference voltage Vtarget are compared. If the charging voltage Vsen on the sensing line is greater than the average reference voltage Vtarget, the first reference voltage Vref1 in the current frame time is increased by the first value ΔV and is used as the reference voltage in the next frame time, that is, the first reference voltage Vref1'=Vref1+ΔV is used during the internal compensation of the corresponding pixel circuit in the next frame time. If the charging voltage Vsen on the sensing line is smaller than the average reference voltage Vtarget, the first reference voltage Vref1 in the current frame time is decreased by the first value ΔV and is used as the reference voltage in the next frame time, that is, the first reference voltage Vref1'=Vref1−ΔV is used during the internal compensation of the corresponding pixel circuit in the next frame time.

Then, in the next frame time of the image display, the corresponding pixel circuit is internally compensated according to the adjusted first reference voltage Vref1', and then the corresponding pixel circuit is externally compensated according to the adjusted first reference voltage Vref1'. The charging voltage Vsen on the sensing line of the corresponding pixel circuit when external compensation is performed is obtained, and then judging whether the charging voltage Vsen on the sensing line is the same as the average reference voltage Vtarget. If different, the first reference voltage Vref1' of the pixel circuit is further adjusted according to the above manner until the charging voltage Vsen on the sensing line is equal to the average reference voltage Vtarget.

Therefore, in the present disclosure, before the normal display of the image, external compensation is performed for the full screen with a fixed reference voltage Vref2 and the detection voltage, and the sensing line Sense Line is charged for the same time Ta, and then obtain the average reference voltage Vtarget according to the detected charging voltage on the sense line Sense Line of the full screen. The normal display can be performed after the initial external compensation is completed. During the normal display, the internal compensation is performed, and the external compensation is performed during the black insertion time. In the present disclosure, during the first frame time, external compensation is performed according to the reference voltage Vref2 and the detected voltage, and the detected charging voltage Vsen on the sense line Sense Line is compared with the average reference voltage Vtarget. If Vsen>Vtarget, the reference voltage Vref2 is increased. If Vsen<Vtarget, the reference voltage Vref2 is decreased, and then the corresponding pixel circuit is internally compensated according to the adjusted reference voltage in the next frame time. Accordingly, by repeatedly adjusting and comparing, the charging voltage Vsen on the sensing line is finally made equal to the average reference voltage Vtarget. Therefore, the external reference compensation adjusts the reference voltage level during internal compensation, and finally achieves the purpose of improving the display effect.

In summary, according to the method for display compensation of the arrangement of the present disclosure, each pixel circuit is initially compensated before the image display to obtain an average reference voltage of the plurality of pixel circuits, and then the display substrate is controlled to display the image, and each pixel circuit is externally compensated within one frame of the image display, and the charging voltage on the sensing line of each pixel circuit during the external compensation is obtained, and a first reference voltage of each pixel circuit is obtained according to the charging voltage on the sensing line and the average reference voltage and each pixel circuit is internally compensated according to the first reference voltage. Thus, not only the threshold voltage compensation of the driving transistor can be realized, but also a large characteristic change of the driving transistor can be covered, the characteristic change of the driving transistor can be compensated in real time, and the trace generated by the external compensation can be eliminated, so that the display effect is further improved.

Figure 5:
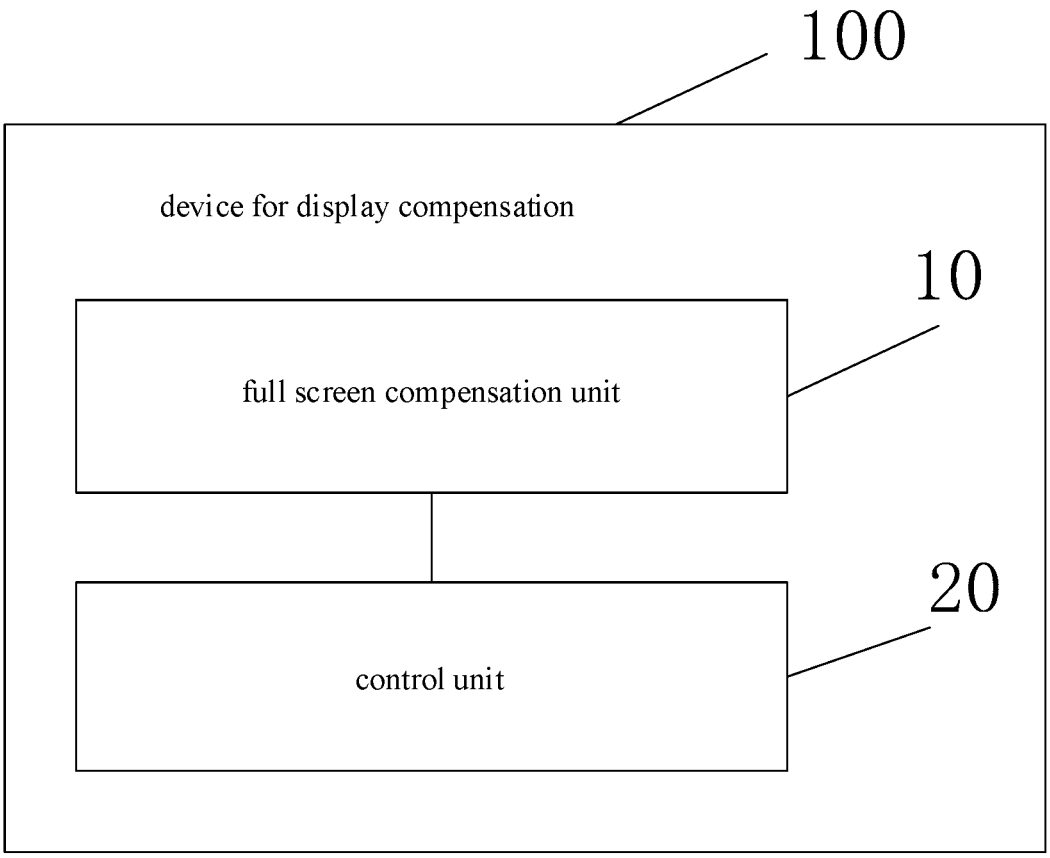
FIG. 5 is a schematic block diagram illustration the device for display compensation according to arrangements of the present disclosure.

FIG. 5 is a schematic block diagram illustration the device for display compensation according to arrangements of the present disclosure.

The device for display compensation according to arrangements of the present disclosure is applicable to compensate a display substrate including a plurality of pixel circuits each including a driving transistor, a data line, a sensing line and a first power line.

As illustrated in FIG. 5, the device for display compensation 100 according to arrangements of the present disclosure a full screen compensation unit 10 and a control unit 20. In the arrangement, the full screen compensation unit 10 is configured to, before displaying an image, perform initial compensation on each of the pixel circuits to obtain an average reference voltage of the plurality of pixel circuits, and the control unit 20 is configured to control the display substrate to display an image and perform external compensation on each of the pixel circuits during a display duration of one frame of the image, obtain a charging voltage on the sensing line of each of the pixel circuits during the external compensation, obtain a first reference voltage of each of the pixel circuits according to the charging voltage on the sensing line and the average reference voltage, and perform internal compensation on each of the pixel circuits according to the first reference voltage.

According to an arrangement of the present disclosure, each unit (e.g., the full screen compensation unit 10 and the control unit 20) or the like may be implemented by a corresponding hardware entity. For example, the various units may be implemented by a corresponding hardware entity such as a processor, a microprocessor, a logic circuit, and the like, and these hardware entities are configured to perform the corresponding operations. However, the present disclosure is not limited thereto, and each unit may be implemented by a corresponding software module. For example, each unit may include corresponding software algorithms, computer readable instructions, and the like that, when executed in the terminal, enable the device to perform the corresponding operations.

According to an arrangement of the present disclosure, when the full screen compensation unit 10 performs initial compensation on each of the pixel circuits to obtain an average reference voltage of the plurality of pixel circuits, the full screen compensation unit 10 provides a detection voltage to the data line of each of the pixel circuits and maintains the detection voltage for a first time to turn on the driving transistor of each of the pixel circuits, and provides a second reference voltage to the sensing line of each of the pixel circuits during the first time and then floats the sensing line of each of the pixel circuits, to charge a corresponding sensing line with a voltage of the first power line of each of the pixel circuits; and the full screen compensation unit 10 obtains the charging voltage on the sensing line of each of the pixel circuits, and obtains the average reference voltage by averaging the charging voltage on the sensing line of each of the pixel circuits.

That is to say, before displaying an image, the full screen is sensed firstly by the full screen compensation unit 10, and the sensing method is implemented according to the external compensation waveform. That is, each pixel circuit in the display substrate is compensated by an external compensation method, so that a voltage is obtained on the sensing line of each pixel circuit, and then the average reference voltage of all pixel circuits is calculated based on these voltages.

A specific pixel circuit shown in FIG. 2 will be described in detail below as an example. As shown in FIG. 2, when the initial compensation is performed, high level may be output respectively to the first control line G1 to the third control line G3 of each pixel circuit through the full-screen compensation unit 10 (which may be integrated inside the IC chip of the GOA area). At this time, the first transistor T1 to the third transistor T3 of each pixel circuit are turned on, and the full-screen compensation unit 10 outputs the detection voltage V1 (such as 3V) to the data line DATA of each pixel circuit, and outputs the second reference voltage Vref2 to the sensing line Sense Line and then floats the sensing line Sense Line. At this time, the driving transistor DT in the pixel circuit is turned on, and the voltage of the first power supply line VDD of the pixel circuit charges the sense line Sense Line through the third transistor T3 and the driving transistor DT. When the charging time reaches the first time Ta (Ta needs to ensure that the sensing line Sense Line is not charged to the saturation state), the full-screen compensation unit 10 obtains the charging voltage on the sensing line Sense Line of each pixel circuit, and then sums the acquired charging voltage on each sensing line Sense Line up and then divides the sum by the total number of the pixel circuit, to obtain the average reference voltage Vtarget.

It should be noted that, in the arrangement of the present disclosure, other methods may be used to externally compensate the pixel circuit to obtain the average reference voltage Vtarget. However, the above manner is relatively simple and easy to implement, so it is optional to adopt the above external compensation method to obtain the average reference voltage Vtarget.

According to an arrangement of the present disclosure, during the display duration of one frame of the image, the control unit 20 performs the internal compensation and then the external compensation on each of the pixel circuits.

In particular, one frame time of the image display may be divided into a display time and a black insertion time (blank area). In the present arrangement, in the display time, internal compensation is performed by the control unit 20 (which may be integrated inside the IC chip of the GOA area) on corresponding pixel circuit according to the first reference voltage of the pixel circuit obtained by external compensation according to the previous frame time, and then in the black insertion time, externally compensation is performed on the corresponding pixel circuit according to the first reference voltage used for internal compensation, and the reference voltage obtained by external compensation is used as the first reference voltage when performing internal compensation on the pixel circuit during the next frame. That is, in the present disclosure, the control unit 20 adjusts the reference voltage of the corresponding pixel circuit during internal compensation by external compensation, thus achieving the purpose of improving the display effect.

It should be noted that, while displaying image, since the internal compensation is performed and then the external compensation is performed during every frame, when the internal compensation is performed in the first frame time, the control unit 20 directly uses the second reference voltage Vref2 used in the full screen external compensation. That is, in the first frame time, the control unit 20 uses the second reference voltage Vref2 for both the internal compensation and external compensation, and then the reference voltage obtained by external compensation in the first frame time is taken as the first reference voltage of the corresponding pixel circuit in the next frame time.

According to an arrangement of the present disclosure, when the control unit 20 performs internal compensation on any one of the pixel circuits according to the first reference voltage, the control unit 20 divides the display duration of one frame of the image into a plurality of stages. The plurality of stages includes a reset stage and an internal compensation stage. In the reset stage, the control unit 20 provides the first reference voltage to the data line of the pixel circuit to reset a gate electrode of the driving transistor of the pixel circuit; and in the internal compensation stage, the control unit 20 supplies the first reference voltage to the data line of the pixel circuit, and turns on the driving transistor of the pixel circuit, to charge a source electrode of the driving transistor with a voltage of the first power line of the pixel circuit, to perform internal compensation on the driving transistor.

In particular, the pixel circuit shown in FIG. 2 is still taken as an example. As shown in FIG. 2 and FIG. 3, one frame time of the image display may include a display time and a black insertion time. The display time may further include multiple stages, which are a reset stage, an internal compensation stage, a data writing phase, and an emission stage.

In the arrangement, in the reset stage t1, the control unit 20 outputs a high level to the first control line G1 and the second control line G2, respectively, and the first transistor T1 and the second transistor T2 are both turned on, and at the same time, the control unit 20 outputs the first reference voltage Vref1 of the pixel circuit (if it is the first frame time, the reference voltage is the reference voltage Vref2) obtained by the external compensation in the previous frame time to the data line DATA, and input a reset voltage (such as 0V) to the sensing line Sense Line, to reset the voltage across the storage capacitor C1.

In the internal compensation stage t2: the control unit 20 outputs a high level to the first control line G1 and the third control line G3, respectively, the first transistor T1 and the third transistor T3 are both turned on, and the control unit 20 outputs the first reference voltage Vref1 of the pixel circuit obtained by external compensation of the previous frame (if it is the first frame time, the reference voltage is the reference voltage Vref2) to the data line DATA, the driving transistor DT is turned on, the source electrode of the drive transistor DT (i.e., point S) is charged by the voltage of the first power line VDD, to perform threshold voltage compensation.

In the data writing stage t3: the control unit 20 outputs a high level to the first control line G1, and the first transistor T1 is turned on. At the same time, the control unit 20 outputs the display data voltage Vdata to the data line DATA to write the display data voltage Vdata to the gate of the driving transistor DT. At this time, the voltage of the gate (i.e., point g) of the driving transistor DT is Vdata, and the source of the driving transistor DT (i.e., point S) is pulled up due to the capacitive coupling principle of the storage capacitor C1.

In the emission stage t4: the control unit 20 outputs a high level to the third control line G3, and the third transistor T3 is turned on, and under the action of the storage capacitor C1, the driving transistor DT is turned on, and the anode voltage of the light emitting device OLED (i.e., the voltage at the point S) is gradually increased to the light-emitting voltage of the light-emitting device OLED, and the light-emitting device OLED emits light.

Thus, the control unit 20 may effectively improve the display effect of the entire display substrate by internally compensating the pixel circuit with the reference voltage obtained by external compensation.

After the control unit 20 completes the internal compensation of the pixel circuit, the pixel circuit is externally compensated during the black insertion time of the current frame, and the charging voltage on the sensing line during external compensation is obtained to further obtain the first reference voltage of the pixel circuit while performing internal compensation in the next frame time according to the charging voltage of the sensing line and the average reference voltage.

According to an arrangement of the present disclosure, when the control unit 20 performs external compensation on any one of the pixel circuits and obtains a charging voltage on the sensing line of the pixel circuit during the external compensation, the control unit 20 provides a detection voltage to the data line of the pixel circuit and maintains the detection voltage for a first time to turn on the driving transistor of the pixel circuit, and applies a first reference voltage in a duration of current frame to the sensing line of the pixel circuit and then floats the sensing line during the first time, to charge the sensing line with a voltage of the first power line of the pixel circuit; and the control unit 20 obtains the charging voltage on the sensing line of the pixel circuit during the external compensation by obtaining a charging voltage on the sensing line during the first time.

In particular, as shown in FIG. 2, in the external compensation, the control unit 20 respectively outputs the high level to the first control line G1 to the third control line G3 through the external control unit, and the first transistor T1 to the third transistor T3 are all turned on. At the same time, the control unit 20 outputs the detection voltage V1 (for example, 3V) to the data line DATA of the pixel circuit, and outputs the first reference voltage Vref1 when the pixel circuit performs internal compensation in the current frame time to the sensing line Sense Line and then floats the sensing line Sense Line. At this time, the driving transistor DT is turned on, and the voltage of the first power line VDD charges the sensing line Sense Line through the third transistor T3 and the driving transistor DT. When the charging time reaches the first time Ta, the control unit 20 obtains the charging voltage on the sensing line Sense Line, that is, the charging voltage Vsen on the sensing line of the pixel circuit during the external compensation is obtained.

It should be noted that, in this example, the control unit 20 controls the first transistor T1 to be turned on, and inputs the detection voltage V1 (such as 3V) to the data line DATA to ensure that the detection voltage used during the external compensation for the pixel circuit in each frame time and that used during the external compensation of the full screen are the same. While in other arrangements of the present disclosure, the detection voltage used for external compensation of the full screen may also be set to the display data voltage Vdata, so that during each frame time, when the control unit 20 performs externally compensated on the pixel circuit, the first transistor T1 may be kept off by the energy storage function of the storage capacitor C1, and meanwhile ensure that the detection voltage used during the external compensation for the pixel circuit in each frame time and that used during the external compensation of the full screen are the same.

Specifically, as shown in FIG. 2 and FIG. 3, in the external compensation, the high level is respectively output to the second control line G2 and the third control line G3 through the control unit 20, and the second transistor T2 and the third transistors T3 are all turned on. At the same time, the control unit 20 outputs the first reference voltage Vref1 when the pixel circuit performs internal compensation in the current frame time to the sensing line Sense Line and then causes the sensing line Sense Line to be in a floating state. At this time, under the action of the storage capacitor C1, the driving transistor DT is turned on, and the voltage of the first power source line VDD charges the sensing line Sense Line through the third transistor T3 and the driving transistor DT. When the charging time reaches the first time Ta, the control unit 20 obtains the charging voltage on the sensing line Sense Line, that is, the charging voltage Vsen on the sensing line of the pixel circuit during the external compensation is obtained.

That is, no matter which method is adopted, the device is functional as long as the detection voltage used for external compensation of the pixel circuit in each frame time is the same as the detection voltage used for external compensation of the full screen, that is, as long as the charging voltage Vsen on the sensing line and the average reference voltage Vtarget are obtained under the same condition. Accordingly, the first reference voltage used in the internal compensation of the corresponding pixel circuit obtained according to the charging voltage Vsen on the sensing line and the average reference voltage Vtarget is relatively reliable.

According to another arrangement of the present disclosure, when the control unit 20 performs external compensation any one of the pixel circuits and obtains a charging voltage on the sensing line of the pixel circuit during the external compensation, the control unit 20 provides a detection voltage to the data line of the pixel circuit to turn on the driving transistor of the pixel circuit, and applies a first reference voltage in a duration of current frame to the sensing line of the pixel circuit and then floats the sensing line, to charge the sensing line with a voltage of the first power line of the pixel circuit; the control unit 20 obtains charging voltages on the sensing line corresponding to any two moments in the charging process, and respectively identifying the charging voltages as a first voltage and a second voltage; and the control unit 20 obtains a charging voltage on the sensing line at the time when a charging time reaches the first time according to the any two moments, the first voltage and the second voltage, to obtain the charging voltage on the sensing line of the pixel circuit during the external compensation.

Specifically, as shown in FIG. 2, in the external compensation, the control unit 20 may respectively output the high level to the first control line G1 to the third control line G3, and the first transistor T1 to the third transistor T3 are turned on in this case. At the same time, the control unit 20 outputs the detection voltage V1 (such as 3V) to the data line DATA of the pixel circuit, and outputs the first reference voltage Vref1 when the pixel circuit performs internal compensation in the current frame time to the sensing line Sense Line and then flows the sensing line Sense Line. At this time, the driving transistor DT is turned on, and the voltage of the first power line VDD is charged to the sensing line Sense Line through the third transistor T3 and the driving transistor DT. During the charging process, the charging voltages on the sensing line corresponding to any two moments are obtained by the control unit 20. For example, as shown in FIG. 4, the first voltage Vsen1 corresponding to the first time t1 and the second voltage Vsen2 corresponding to the second time t2 are acquired (The first time t1 and the second time t2 are both smaller than the first time Ta), and then according to the voltage difference ΔVsen between the second voltage Vsen2 and the first voltage Vsen1 and the time difference Δt between the second time t2 and the first time t1, the voltage on the sense line Sense Line when the charging time reaches the first time Ta is calculated, to obtain the charging voltage Vsen on the sensing line of the pixel circuit when external compensation is obtained, that is, $Vsen=Vsen1+(Vsen2-Vsen1)*[(Ta-t1)/(t2-t1)]$.

Alternatively, as shown in FIG. 2 and FIG. 3, in external compensation, a high level may be respectively output to the second control line G2 and the third control line G3 through the control unit 20, and the second transistor T2 and the third transistor T3 are turned on. Tt this time and, the control unit 20 outputs the first reference voltage Vref1 when the pixel circuit performs internal compensation in the current frame time to the sensing line Sense Line and then makes the sensing line Sense Line in a floating state. At this time, under the action of the storage capacitor C1, the driving transistor DT is turned on, and the voltage of the first power supply line VDD charges the sensing line Sense Line through the third transistor T3 and the driving transistor DT. During the charging process, the charging voltages on the sensing line corresponding to any two moments are obtained by the control unit 20, for example, the first voltage Vsen1 corresponding to the first time t1 and the second voltage Vsen2 corresponding to the second time t2 are obtained, and then according to the voltage difference ΔVsen between the first voltage Vsen1 the second voltage Vsen2 and the time difference Δt between the second time t2 and the first time t1, the voltage on the corresponding sensing line Sense Line when the charging time reaches the first time Ta is calculated, to obtain the charging voltage Vsen on the sensing line of the pixel circuit at the time of external compensation, that is, Vsen=Vsen1+(Vsen2−Vsen1)*[(Ta−t1)/(t2−t1)].

That is, when the charging voltage Vsen on the sensing line of the pixel circuit is obtained by the control unit 20, the sensing line Sense Line can be charged to the first time Ta, and then the voltage on the sensing line Sense Line is obtained; or, during charging of the sensing line Sense Line, the control unit 20 predicts the charging voltage Vsen on the sensing line Sense Line when the charging time reaches the first time Ta according to the rate of change of the voltage on the sensing line Sense Line. Among them, for the former, the charging voltage Vsen on the sensing line obtained is more accurate, and for the latter, the detection time is shorter, and the external compensation time is effectively shortened.

Further, after obtaining the charging voltage Vsen and the average reference voltage Vtarget on the sensing line, the control unit 20 may start to obtain the first reference voltage Vref1 used in the internal compensation of the corresponding pixel circuit in the next frame time according to the charging voltage Vsen on the sensing line and the average reference voltage Vtarget.

According to an arrangement of the present disclosure, when the control unit 20 obtains a first reference voltage of any one of the pixel circuits according to the charging voltage on the sensing line and the average reference voltage, the control unit 20 increases the first reference voltage of the pixel circuit by a first value in a case where the charging voltage on the sensing line of the pixel circuit is greater than the average reference voltage, to obtain a first reference voltage of the pixel circuit during a next frame; and the control unit 20 decreases the first reference voltage of the pixel circuit by a first value in a case where the charging voltage on the sensing line of the pixel circuit is lower than the average reference voltage, to obtain the first reference voltage of the pixel circuit during the next frame.

Specifically, after the control unit 20 obtains the charging voltage Vsen on the sensing line in the above manner, the charging voltage Vsen on the sensing line and the average reference voltage Vtarget are compared. If the charging voltage Vsen on the sensing line is greater than the average reference voltage Vtarget, the control unit 20 increases the first reference voltage Vref1 in the current frame time by the first value ΔV and is used as the reference voltage in the next frame time, that is, the first reference voltage Vref1'=Vref1+ΔV is used during the internal compensation of the corresponding pixel circuit in the next frame time. If the charging voltage Vsen on the sensing line is smaller than the average reference voltage Vtarget, the control unit 20 decreases the first reference voltage Vref1 in the current frame time by the first value ΔV and is used as the reference voltage in the next frame time, that is, the first reference voltage Vref1'=Vref1−ΔV is used during the internal compensation of the corresponding pixel circuit in the next frame time.

Then, in the next frame time of the image display, the control unit 20 internally compensates the corresponding pixel circuit according to the adjusted first reference voltage Vref1', and then externally compensates the corresponding pixel circuit according to the adjusted first reference voltage Vref1'. The charging voltage Vsen on the sensing line of the corresponding pixel circuit when external compensation is performed is obtained, and then judging whether the charging voltage Vsen on the sensing line is the same as the average reference voltage Vtarget. If different, the first reference voltage Vref1' of the pixel circuit is further adjusted according to the above manner until the charging voltage Vsen on the sensing line is equal to the average reference voltage Vtarget.

Therefore, in the present disclosure, before the normal display of the image, the full screen compensation unit 10 performs external compensation for the full screen with a fixed reference voltage Vref2 and the detection voltage, and the sensing line Sense Line is charged for the same time Ta, and then obtain the average reference voltage Vtarget according to the detected charging voltage on the sense line Sense Line of the full screen. The normal display can be performed after the initial external compensation is completed. During the normal display, the control unit 20 performs the internal compensation, and the external compensation is performed during the black insertion time. In the present disclosure, during the first frame time, the control unit 20 performs external compensation according to the reference voltage Vref2 and the detected voltage, and the detected charging voltage Vsen on the sense line Sense Line is compared with the average reference voltage Vtarget. If Vsen>Vtarget, the reference voltage Vref2 is increased. If Vsen<Vtarget, the reference voltage Vref2 is decreased, and then the corresponding pixel circuit is internally compensated according to the adjusted reference voltage in the next frame time. Accordingly, by repeatedly adjusting and comparing, the charging voltage Vsen on the sensing line is finally made equal to the average reference voltage Vtarget. Therefore, the external reference compensation adjusts the reference voltage level during internal compensation, and finally achieves the purpose of improving the display effect.

According to the device for display compensation of the arrangement of the present disclosure, each pixel circuit is initially compensated by the full screen compensation unit before the image display to obtain an average reference voltage of the plurality of pixel circuits, and then the control unit controls the display substrate to display the image, and each pixel circuit is externally compensated within one frame of the image display, and the charging voltage on the sensing line of each pixel circuit during the external compensation is obtained, and a first reference voltage of each pixel circuit is obtained according to the charging voltage on the sensing line and the average reference voltage and each pixel circuit is internally compensated according to the first reference voltage. Therefore, not only the threshold voltage compensation of the driving transistor can be realized, but also a large characteristic change of the driving transistor can be covered, the characteristic change of the driving transistor can be compensated in real time, and the trace generated by the external compensation can be eliminated, so that the display effect is further improved.

Figure 6:
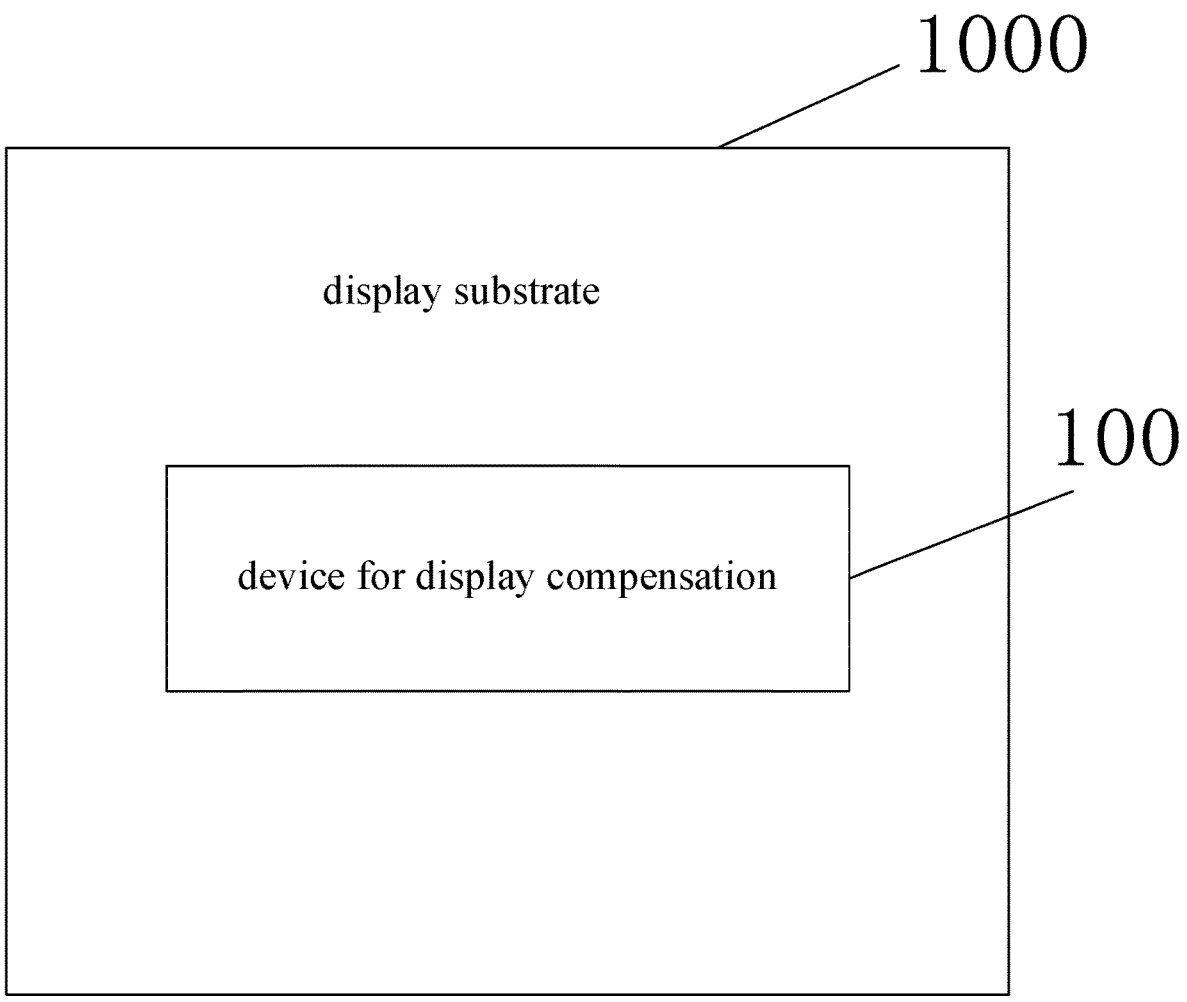
FIG. 6 is a schematic block diagram illustration the display substrate according to arrangements of the present disclosure.

FIG. 6 is a schematic block diagram illustration the display substrate according to arrangements of the present disclosure. As shown in FIG. 6, the display substrate 1000 of the arrangement of the present disclosure includes the device for display compensation 100 described above.

According to the display substrate of the arrangement of the present disclosure, with the above device for display compensation, not only the threshold voltage compensation of the driving transistor can be realized, but also a large characteristic change of the driving transistor can be covered, the characteristic change of the driving transistor can be compensated in real time, and the trace generated by the external compensation can be eliminated, so that the display effect is further improved.

Figure 7:
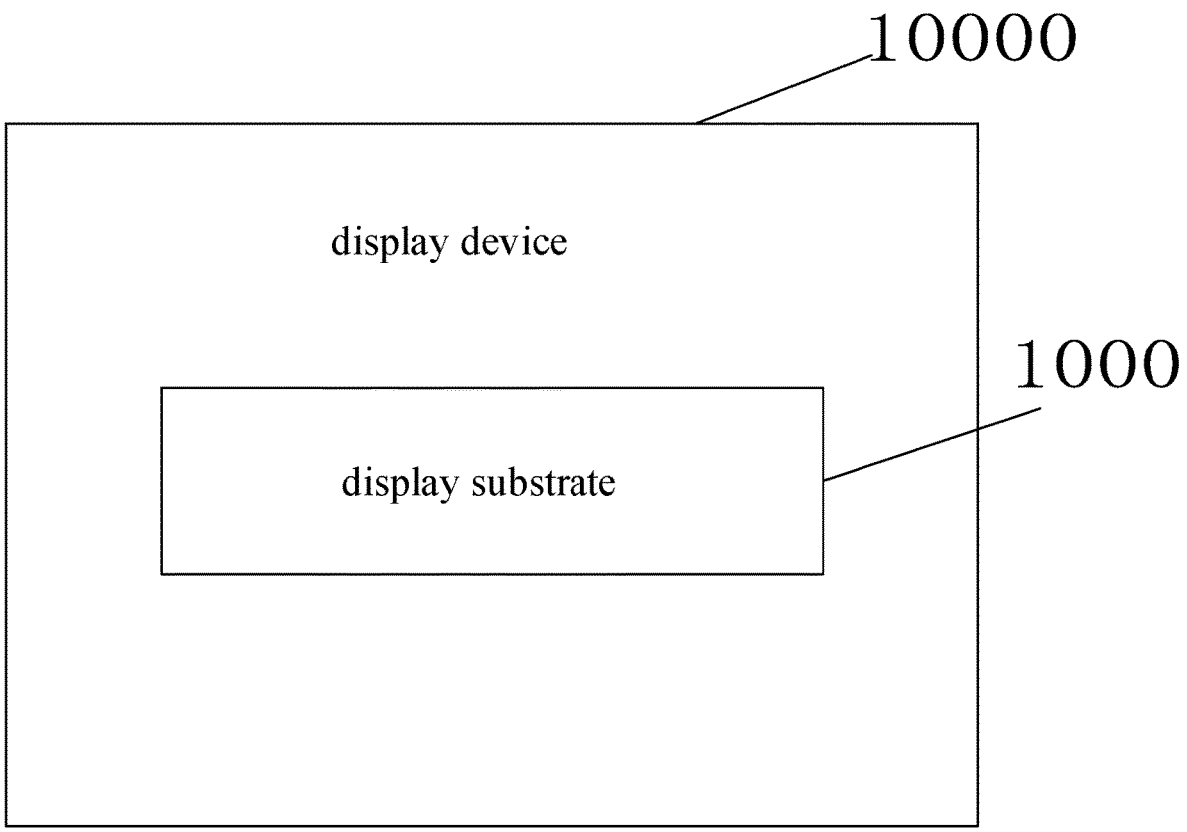
FIG. 7 is a schematic block diagram illustration the display device according to arrangements of the present disclosure.

FIG. 7 is a schematic block diagram illustration the display device according to arrangements of the present disclosure. As shown in FIG. 7, the display device 10000 according to the arrangement of the present disclosure includes the display substrate 1000 described above.

According to the display device of the arrangement of the present disclosure, with the above device for display compensation, not only the threshold voltage compensation of the driving transistor can be realized, but also a large characteristic change of the driving transistor can be covered, the characteristic change of the driving transistor can be compensated in real time, and the trace generated by the external compensation can be eliminated, so that the display effect is further improved.

In the description of the present disclosure, the terms "first" and "second" are used for descriptive purposes only, and are not to be construed as indicating or implying a relative importance or implicitly indicating the number of technical features indicated. Thus, features defining "first" or "second" may include at least one of the features, either explicitly or implicitly. In the description of the present disclosure, the meaning of "a plurality" is at least two, such as two, three, etc., unless specifically defined otherwise.

In the present disclosure, the terms "mount", "interconnect", "connect", "fix", and the like, are to be understood broadly, and may be either a fixed connection or a detachable connection, or integrated, unless explicitly stated or defined otherwise; may be mechanical or electrical connection; may be directly connected, or indirectly connected through an intermediate medium, and may be the internal communication of two components or the interaction of two components, unless otherwise specified Limited. For those of ordinary skill in the art, the specific meanings of the above terms in the present disclosure can be understood on a case-by-case basis.

In the description of the present specification, the description with reference to the terms "one arrangement", "some arrangements", "example", "specific example", or "some examples" and the like may indicate that a specific feature structure, material, or feature described in connection with the arrangement or example is included in at least one arrangement or example of the present disclosure. In the present specification, the schematic representation of the above terms is not necessarily directed to the same arrangement or example. Furthermore, the particular features, structures, materials, or characteristics described may be combined in a suitable manner in any one or more arrangements or examples. In addition, various arrangements or examples described in the specification, as well as features of various arrangements or examples, may be combined by those skilled in the art if they are not contradicting each other.

While the arrangements of the present disclosure have been shown and described above, it is understood that the above-described arrangements are illustrative and are not to be construed as limiting the scope of the disclosure. Variations, modifications, alterations and variations of the above-described arrangements may be made by those skilled in the art within the scope of the present disclosure.

What is claimed is:

1. A method for display compensation, which is applicable to compensate a display substrate including a plurality of pixel circuits each including a driving transistor, a data line, a sensing line and a first power line, the method comprising:

before displaying an image, performing initial compensation on each of the plurality of pixel circuits to obtain an average reference voltage of the plurality of pixel circuits;

controlling the display substrate to display the image and performing external compensation on each of the plurality of pixel circuits during a display duration of one frame of the image;

obtaining a charging voltage on the sensing line of each of the plurality of pixel circuits during the external compensation;

obtaining a first reference voltage of each of the plurality of pixel circuits according to the charging voltage on the sensing line and the average reference voltage; and performing internal compensation on each of the plurality of pixel circuits according to the first reference voltage, wherein the internal compensation comprises: supplying the first reference voltage to the data line of a pixel circuit of the plurality of pixel circuits, and turning on the driving transistor of the pixel circuit, to charge a source electrode of the driving transistor with a voltage of the first power line of the pixel circuit, to compensate for threshold voltage of the driving transistor, wherein the external compensation comprises: providing a detection voltage to data lines of the plurality of pixel circuits, and obtaining charging voltages on sensing lines of the plurality of pixel circuits, and wherein the initial compensation comprises: sensing all of the plurality of pixel circuits through the sensing lines using the external compensation.

2. The method for display compensation according to claim 1, wherein the performing initial compensation on each of the plurality of pixel circuits to obtain the average reference voltage of the plurality of pixel circuits comprises:

providing the detection voltage to the data line of each of the plurality of pixel circuits and maintaining the detection voltage for a first time to turn on the driving transistor of each of the plurality of pixel circuits, and providing a second reference voltage to the sensing line of each of the plurality of pixel circuits and then floating the sensing line of each of the plurality of pixel circuits during the first time, to charge a corresponding sensing line with a voltage of the first power line of each of the plurality of pixel circuits; and obtaining the charging voltage on the sensing line of each of the plurality of pixel circuits, and obtaining the average reference voltage by averaging the charging voltage on the sensing line of each of the plurality of pixel circuits.

3. The method for display compensation according to claim 1, wherein during the display duration of one frame of the image, the internal compensation and then the external compensation are performed on each of the plurality of pixel circuits.

4. The method for display compensation according to claim 3, wherein performing external compensation on any one of the plurality of pixel circuits during the display duration of one frame of the image, and obtaining the charging voltage on the sensing line of the pixel circuit during the external compensation comprises:

providing the detection voltage to the data line of the pixel circuit and maintaining the detection voltage for a first time to turn on the driving transistor of the pixel circuit, and applying the first reference voltage in a duration of current frame to the sensing line of the pixel circuit and then floating the sensing line during the first time, to charge the sensing line with a voltage of the first power line of the pixel circuit; and obtaining the charging voltage on the sensing line of the pixel circuit during the external compensation by obtaining a charging voltage on the sensing line during the first time.

5. The method for display compensation according to claim 4, wherein the obtaining the first reference voltage of any one of the plurality of pixel circuits according to the charging voltage on the sensing line and the average reference voltage comprises:

increasing the first reference voltage of the pixel circuit by a first value in a case where the charging voltage on the sensing line of the pixel circuit is greater than the average reference voltage, to obtain a first reference voltage of the pixel circuit during a next frame; and decreasing the first reference voltage of the pixel circuit by the first value in a case where the charging voltage on the sensing line of the pixel circuit is lower than the average reference voltage, to obtain the first reference voltage of the pixel circuit during the next frame.

6. The method for display compensation according to claim 3, wherein performing external compensation on any one of the plurality of pixel circuits during the display duration of one frame of the image, and obtaining the charging voltage on the sensing line of the pixel circuit during the external compensation comprises:

providing the detection voltage to the data line of the pixel circuit to turn on the driving transistor of the pixel circuit, and applying the first reference voltage in a duration of current frame to the sensing line of the pixel circuit and then floating the sensing line, to charge the sensing line with a voltage of the first power line of the pixel circuit;

obtaining charging voltages on the sensing line corresponding to any two moments in a charging process, and respectively identifying the charging voltages as a first voltage and a second voltage; and obtaining a charging voltage on the sensing line at a time when a charging time reaches a first time according to the any two moments, the first voltage and the second voltage, to obtain the charging voltage on the sensing line of the pixel circuit during the external compensation.

7. The method for display compensation according to claim 6, wherein the obtaining the first reference voltage of any one of the plurality of pixel circuits according to the charging voltage on the sensing line and the average reference voltage comprises:

increasing the first reference voltage of the pixel circuit by a first value in a case where the charging voltage on the sensing line of the pixel circuit is greater than the average reference voltage, to obtain a first reference voltage of the pixel circuit during a next frame; and decreasing the first reference voltage of the pixel circuit by the first value in a case where the charging voltage on the sensing line of the pixel circuit is lower than the average reference voltage, to obtain the first reference voltage of the pixel circuit during the next frame.

8. The method for display compensation according to claim 1, wherein the performing internal compensation on any one of the plurality of pixel circuits according to the first reference voltage further comprises:

providing the first reference voltage to the data line of the pixel circuit to reset a gate electrode of the driving transistor of the pixel circuit.

9. A device for display compensation, which is applicable to compensate a display substrate including a plurality of pixel circuits each including a driving transistor, a data line, a sensing line and a first power line, the device comprising:

a full screen compensation circuit configured to, before displaying an image, perform initial compensation on each of the plurality of pixel circuits to obtain an average reference voltage of the plurality of pixel circuits;

a control circuit configured to control the display substrate to display the image and perform external compensation on each of the plurality of pixel circuits during a display duration of one frame of the image, obtain a charging voltage on the sensing line of each of the plurality of pixel circuits during the external compensation, obtain a first reference voltage of each of the plurality of pixel circuits according to the charging voltage on the sensing line and the average reference voltage, and perform internal compensation on each of the plurality of pixel circuits according to the first reference voltage, wherein the internal compensation comprises: supplying the first reference voltage to the data line of a pixel circuit of the plurality of pixel circuits, and turning on the driving transistor of the pixel circuit, to charge a source electrode of the driving transistor with a voltage of the first power line of the pixel circuit, to compensation for threshold voltage of the driving transistor, wherein the external compensation comprises: providing a detection voltage to data lines of the plurality of pixel circuits, and obtaining charging voltages on sensing lines of the plurality of pixel circuits, and wherein the initial compensation comprises: sensing all of the plurality of pixel circuits through the sensing lines using the external compensation.

10. The device for display compensation according to claim 9, wherein when the full screen compensation circuit performs initial compensation on each of the plurality of pixel circuits to obtain the average reference voltage of the plurality of pixel circuits, the full screen compensation circuit provides the detection voltage to the data line of each of the plurality of pixel circuits and maintains the detection voltage for a first time to turn on the driving transistor of each of the plurality of pixel circuits, and provides a second reference voltage to the sensing line of each of the plurality of pixel circuits during the first time and then floats the sensing line of each of the plurality of pixel circuits, to charge a corresponding sensing line with a voltage of the first power line of each of the plurality of pixel circuits; and the full screen compensation circuit obtains the charging voltage on the sensing line of each of the plurality of pixel circuits, and obtains the average reference voltage by averaging the charging voltage on the sensing line of each of the plurality of pixel circuits.

11. The device for display compensation according to claim 9, wherein during the display duration of one frame of the image, the control circuit performs the internal compensation and then the external compensation on each of the plurality of pixel circuits.

12. The device for display compensation according to claim 11, wherein when the control circuit performs external compensation on any one of the plurality of pixel circuits and obtains the charging voltage on the sensing line of the pixel circuit during the external compensation, the control circuit provides the detection voltage to the data line of the pixel circuit and maintains the detection voltage for a first time to turn on the driving transistor of the pixel circuit, and applies the first reference voltage in a duration of current frame to the sensing line of the pixel circuit and then floats the sensing line during the first time, to charge the sensing line with a voltage of the first power line of the pixel circuit; and the control circuit obtains the charging voltage on the sensing line of the pixel circuit during the external compensation by obtaining a charging voltage on the sensing line during the first time.

13. The device for display compensation according to claim 12, wherein when the control circuit obtains the first reference voltage of any one of the plurality of pixel circuits according to the charging voltage on the sensing line and the average reference voltage, the control circuit increases the first reference voltage of the pixel circuit by a first value in a case where the charging voltage on the sensing line of the pixel circuit is greater than the average reference voltage, to obtain the first reference voltage of the pixel circuit during a next frame; and the control circuit decreases the first reference voltage of the pixel circuit by the first value in a case where the charging voltage on the sensing line of the pixel circuit is lower than the average reference voltage, to obtain the first reference voltage of the pixel circuit during the next frame.

14. The device for display compensation according to claim 11, wherein when the control circuit performs external compensation any one of the plurality of pixel circuits and obtains the charging voltage on the sensing line of the pixel circuit during the external compensation, the control circuit provides the detection voltage to the data line of the pixel circuit to turn on the driving transistor of the pixel circuit, and applies the first reference voltage in a duration of current frame to the sensing line of the pixel circuit and then floats the sensing line, to charge the sensing line with a voltage of the first power line of the pixel circuit; the control circuit obtains charging voltages on the sensing line corresponding to any two moments in a charging process, and respectively identifying the charging voltages as a first voltage and a second voltage; and the control circuit obtains a charging voltage on the sensing line at a time when a charging time reaches a first time according to the any two moments, the first voltage and the second voltage, to obtain the charging voltage on the sensing line of the pixel circuit during the external compensation.

15. The device for display compensation according to claim 14, wherein when the control circuit obtains the first reference voltage of any one of the plurality of pixel circuits according to the charging voltage on the sensing line and the average reference voltage, the control circuit increases the first reference voltage of the pixel circuit by a first value in a case where the charging voltage on the sensing line of the pixel circuit is greater than the average reference voltage, to obtain the first reference voltage of the pixel circuit during a next frame; and the control circuit decreases the first reference voltage of the pixel circuit by the first value in a case where the charging voltage on the sensing line of the pixel circuit is lower than the average reference voltage, to obtain the first reference voltage of the pixel circuit during the next frame.

16. The device for display compensation according to claim 11, wherein when the control circuit performs internal compensation on any one of the plurality of pixel circuits according to the first reference voltage, the control circuit provides the first reference voltage to the data line of the pixel circuit to reset a gate electrode of the driving transistor of the pixel circuit.

17. A display substrate comprising the device for display compensation according to claim 9.

18. A display device comprising the display substrate according to claim 17.

* * * * *